US009510071B2

(12) United States Patent
Jones et al.

(10) Patent No.: US 9,510,071 B2
(45) Date of Patent: Nov. 29, 2016

(54) PORTABLE COMMUNICATION DEVICE WITH FLOW THROUGH ACOUSTIC TRANSDUCER PORTS FOR WATER MANAGEMENT

(71) Applicant: HARRIS CORPORATION, Melbourne, FL (US)

(72) Inventors: Kurt E. Jones, Webster, NY (US); James D. Haschmann, Rochester, NY (US); Michael E. Bausch, Livonia, NY (US)

(73) Assignee: Harris Corporation, Melbourne, FL (US)

( * ) Notice: Subject to any disclaimer, the term of this patent is extended or adjusted under 35 U.S.C. 154(b) by 5 days.

(21) Appl. No.: 14/662,364

(22) Filed: Mar. 19, 2015

(65) Prior Publication Data

US 2016/0277818 A1 Sep. 22, 2016

(51) Int. Cl.
*H04R 1/02* (2006.01)

(52) U.S. Cl.
CPC ..... *H04R 1/023* (2013.01); *H04R 2499/11* (2013.01)

(58) Field of Classification Search
CPC ..... H04R 1/02
USPC ..... 381/391
See application file for complete search history.

(56) References Cited

U.S. PATENT DOCUMENTS

| | | | | |
|---|---|---|---|---|
| D374,874 | S | 10/1996 | Lindeman et al. | |
| D477,816 | S | 7/2003 | Yahaya et al. | |
| D483,351 | S | 12/2003 | Jennings et al. | |
| D576,124 | S | 9/2008 | Nishizawa | |
| 7,619,880 | B2 | 11/2009 | Liang et al. | |
| 7,840,021 | B2 | 11/2010 | Greco et al. | |
| 8,199,491 | B2 | 6/2012 | Uchiyama et al. | |
| D663,277 | S | 7/2012 | Yong et al. | |
| D687,816 | S | 8/2013 | Lee | |
| D698,339 | S | 1/2014 | Brinkman et al. | |
| D702,666 | S | 4/2014 | Foster et al. | |
| 8,712,091 | B2 | 4/2014 | Taylor et al. | |
| 2006/0177089 | A1* | 8/2006 | Greco | H04R 1/023 381/391 |
| 2013/0028464 | A1* | 1/2013 | Hayashi | H04R 1/023 381/391 |

* cited by examiner

*Primary Examiner* — Duc Nguyen
*Assistant Examiner* — Phan Le
(74) *Attorney, Agent, or Firm* — Fox Rothschild LLP; Robert J. Sacco; Carol E. Thorstad-Forsyth

(57) ABSTRACT

Communication device includes a housing with a two or more apertures defined therein to form a speaker grille. The apertures are arranged to form one or more aperture sets, each comprised of at least two apertures connected by a fluid channel defined on an internal face of the panel. The fluid channel is comprised of one or more channel segments. Each of the channels segments and the acoustic apertures has a predetermined size and shape which draws fluid through the apertures from an exterior side of the panel, to an interior side of the panel, and then into one of the channel segments. The dimensions and geometry of the channels and apertures are selected to cause the fluid in the channels to exit from the housing at a lowermost one of the acoustic apertures.

19 Claims, 11 Drawing Sheets

FIG. 11
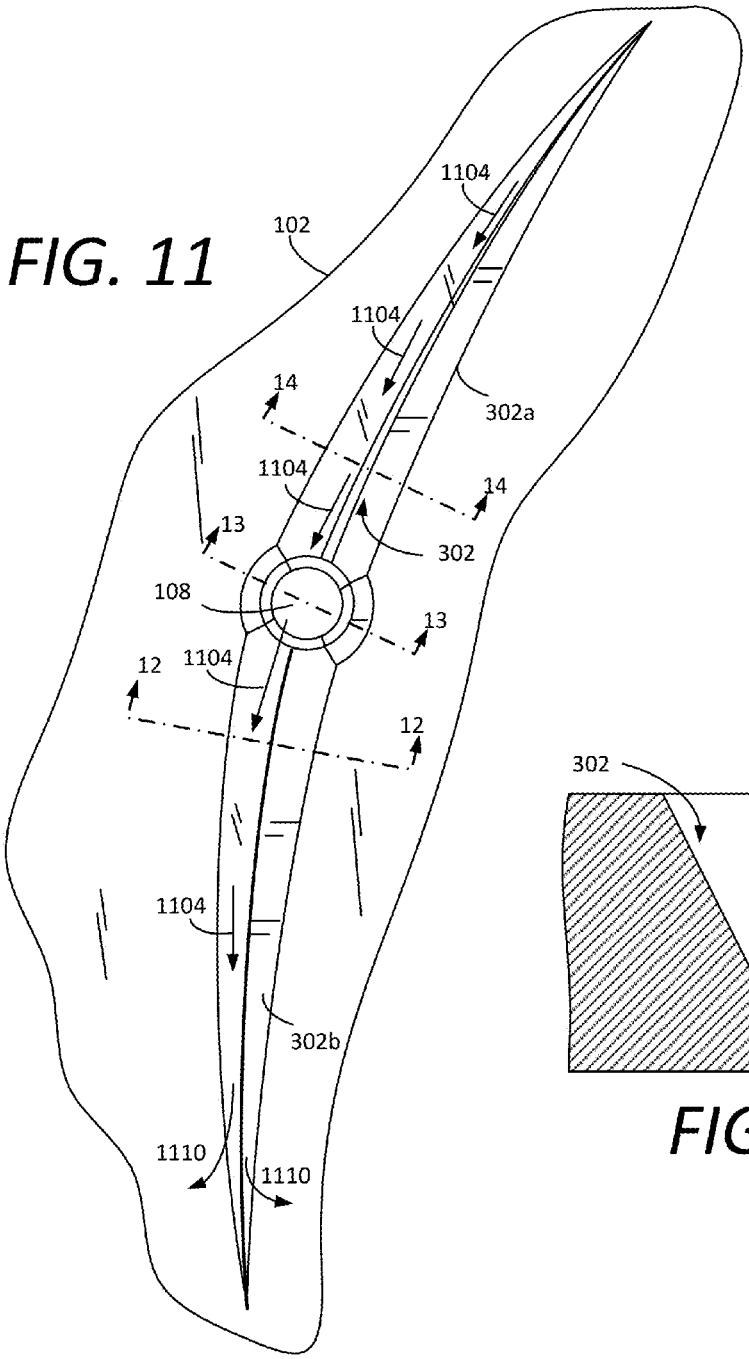
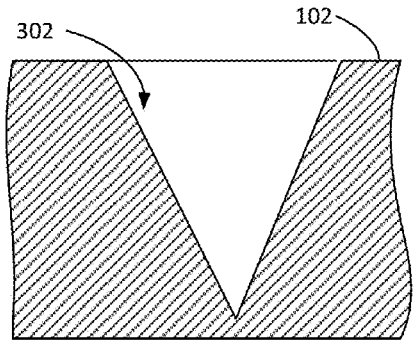
FIG. 12

PORTABLE COMMUNICATION DEVICE WITH FLOW THROUGH ACOUSTIC TRANSDUCER PORTS FOR WATER MANAGEMENT

BACKGROUND OF THE INVENTION

Statement of the Technical Field

The inventive arrangements relate to portable communication devices, and more particularly to acoustic transducer ports used in portable communication devices.

Description of the Related Art

A portable communication device will generally include a housing in which certain components are enclosed. For example, such components can include electronic circuitry (such as a wireless transceiver), one or more control elements, a loudspeaker and/or a microphone. The housing for the portable communication device will usually also include at least one acoustic transducer port such as a speaker grille. The speaker grille permits audio reproduced by the loudspeaker to be more easily communicated from an interior of the housing to an environment external of the housing. The housing can also include a microphone port to facilitate transmission of audio from the environment external of the housing to the microphone, which is located internal of the housing.

Portable communication devices for civilian, public safety and military usage are employed in a wide range of environmental conditions, including conditions that can involve precipitation and water spray. Acoustic transducer ports for loudspeakers and microphones usually include some type of openings formed in the housing to facilitate passage of audio, and therefore have the potential to allow water to intrude into the interior of the housing. Accordingly, various design techniques are commonly used to minimize the risk of water transmission to the interior of the housing from an exterior environment. For example, housing apertures associated with acoustic transducer ports are usually made very small so as to minimize any potential water intrusion associated with precipitation and/or spray. Other techniques involve the use of recessed or shrouded apertures. Sometimes the apertures are formed as slots which can be angled or shielded to help prevent water intrusion. Water or other fluids can become trapped in the speaker grille openings and microphone port, thereby blocking audio output and audio transmissions respectively

SUMMARY OF THE INVENTION

Embodiments of the invention concern a communication device which includes certain water management features. The communication device includes a housing formed of a rigid material which encloses a loudspeaker. The housing includes a panel with a plurality of apertures defined therein to form a speaker grille. The speaker grille facilitates passage of audio from an interior portion of the housing enclosing the loudspeaker to an environment exterior of the housing. Each aperture defines a passage through the panel and decreases in cross sectional area along a direction extending from an exterior side of the panel to an interior side of the panel. The apertures are arranged to form one or more aperture sets, each comprised of at least two apertures connected by a fluid channel defined on an internal face of the panel. The fluid channel is comprised of one or more channel segments, each extending a fluid path between adjacent apertures comprising each aperture set. The fluid channel has a predetermined minimum length which facilitates a gravitational head pressure needed to overcome a capillary force associated with at least one drain aperture. Each of the channel segments and the plurality of apertures has a predetermined geometry and size which assists to draws fluid through the apertures from an exterior side of the panel to an interior side of the panel, into one of the channel segments, and to expel the fluid from the interior side of the panel through the at least one drain aperture.

The invention also concerns a method for clearing water from a speaker grille of a communication device. The method involves providing a housing for the communication device formed of a rigid material which encloses a loudspeaker. A plurality of apertures are disposed in a panel of the housing to form a speaker grille. The speaker grille facilitates passage of audio from an interior portion of the housing enclosing the loudspeaker to an environment exterior of the housing. The apertures are arranged to cause a difference in capillary pressure along their length from an exterior of the housing to the interior of the housing. The difference in capillary pressure draws an accumulation of fluid through the apertures from the exterior side of the panel into to at least one of a plurality of channel segments forming a fluid channel on the interior side of the panel. Thereafter, at least a portion of the fluid from the interior side of the panel is expelled to the exterior side of the panel through at least one drain aperture. This is accomplished by using a gravitational head pressure developed in the fluid channel by the force of gravity.

BRIEF DESCRIPTION OF THE DRAWINGS

Embodiments will be described with reference to the following drawing figures, in which like numerals represent like items throughout the figures, and in which:

FIG. 11 is an enlarged view of a microphone port that is useful for understanding the invention.

FIG. 12 is a cross-sectional view of a fluid channel associated with the microphone port, taken along line 12-12 in FIG. 11.

DETAILED DESCRIPTION

Figure 1:
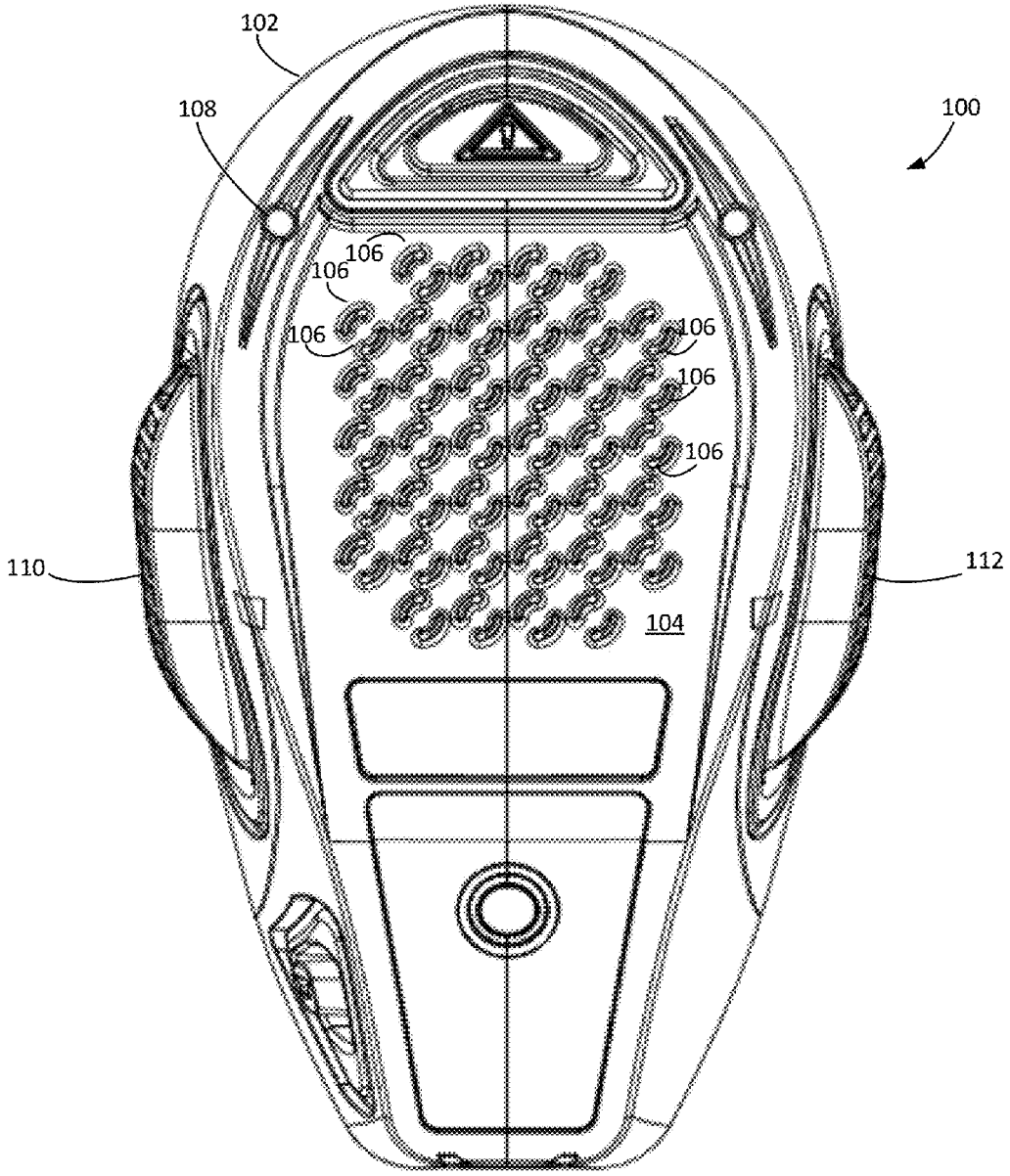
FIG. 1 is a front view of a speaker-microphone that is useful for understanding the inventive arrangements.

It will be readily understood that the components of the embodiments as generally described herein and illustrated in the appended figures could be arranged and designed in a wide variety of different configurations. Thus, the following more detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

Portable communication devices (such as portable radio transceivers) commonly include some type of housing for the radio and loudspeaker components. The housing is usually formed of a rigid material made from metal or polymer, and will conventionally include one or more acoustic transducer ports to allow audio for the loudspeaker and/or microphone(s) to exit or enter an interior portion of the housing. In some cases, such portable communication transceivers can utilize a remote speaker-microphone. A conventional remote speaker-microphone usually includes a loudspeaker, a microphone and certain control elements to facilitate control over a portable radio transceiver. The speaker-microphone is usually positioned a short distance from the portable radio transceiver for user convenience. Audio signals from the portable transceiver are communicated to the speaker-microphone for reproduction as audio. Similarly, speech and other audio is detected by the microphone and communicated to the portable radio transceiver. A wired or wireless link is provided between the speaker microphone and the portable radio transceiver to facilitate these operations. Like the portable radio transceiver, a speaker-microphone will commonly include some type of acoustic transducer ports formed in its housing to facilitate passage of audio between the interior of the housing and the external environment.

Portable radio transceivers and speaker microphones commonly includes a plurality of acoustic transducer ports defined in the housing for such devices. The acoustic transducer ports are usually arranged in some predefined pattern on a panel of the housing to define a speaker grille which encloses the loudspeaker. The acoustic transducer ports conventionally define openings in the panel, and as such have the potential to allow water to intrude into the interior of the housing. Accordingly, various design techniques are conventionally used to minimize the risk of water intrusion to the interior of the housing from an exterior environment. For example, housing apertures associated with acoustic transducer ports are usually made relatively small so as to minimize any potential water intrusion associated with precipitation and/or spray. In some communication devices, the acoustic transducer ports are formed as rectangular slots, which may be angled or shielded to help prevent water intrusion into the housing.

Relatively small acoustic transducer ports which form a speaker grille can help minimize water intrusion, but can also create certain problems. When water from precipitation or spray comes in contact with the speaker grille, it can become lodged in the small apertures or narrow slots in the housing which define the acoustic transducer ports. Draining water from these small cavities can be difficult to achieve due to surface energy between the water and the surrounding walls which define each aperture. This capture of water within the acoustic transducer ports can lead to impaired audio performance when audio is blocked from exiting and/or entering through the transducer ports.

Accordingly, the inventive arrangements concern a communication device with improved water management features associated with acoustic aperture ports. A communication device as referred to herein includes a portable communication device such as a portable radio transceiver. However, a portable communication device can also be understood to include a speaker-microphone as would be used with such a portable radio transceiver. For convenience, the invention will primarily be described in the context of a speaker microphone. However, it should be understood that the inventive arrangements include any type of communication device (including a portable radio transceiver) which includes acoustic aperture ports to facilitate transmission of audio between an interior of a communication device housing and an exterior environment surrounding such housing. As such, the inventive arrangements disclosed herein can concern speaker grilles and microphone ports.

Figure 2A:
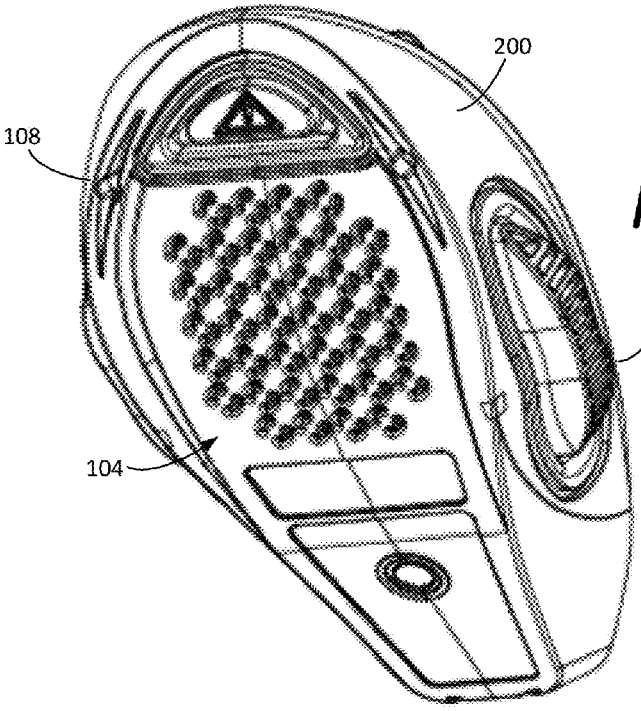
FIG. 2A is front perspective view of a front portion of the housing for the speaker-microphone shown in FIG. 1.
Figure 2B:
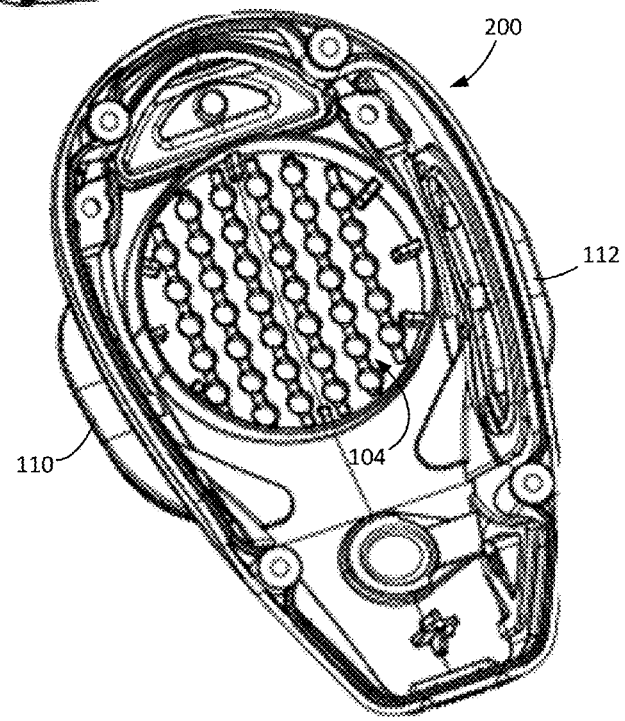
FIG. 2B is a rear perspective view of the front portion of the housing shown in FIG. 2.

Referring now to FIG. 1 there is shown a speaker-microphone 100 for a portable radio transceiver (not shown). The speaker microphone 100 includes a housing 102 which encloses the speaker microphone assembly, including an internal loudspeaker. A front portion 200 of the housing 102 is shown in FIGS. 2A and 2B. The speaker produces audio which is communicated from the interior of the housing to the exterior of the housing through a plurality of acoustic aperture ports 106 disposed in housing panel 104. The acoustic aperture ports 106 are arranged in a pattern on the panel 104 as shown to define a speaker grille. The speaker microphone can also include at least one microphone (not shown) which is disposed within the housing 102. The microphone receives audio from an environment external of the housing 102 through a microphone acoustic aperture port (microphone port) 108. The microphone acoustic aperture port 108 is shown in greater detail in FIG. 3. The speaker microphone can also include one or more control elements 110, 112 for controlling the operation of the speaker-microphone or an associated portable radio transceiver.

Figure 4:
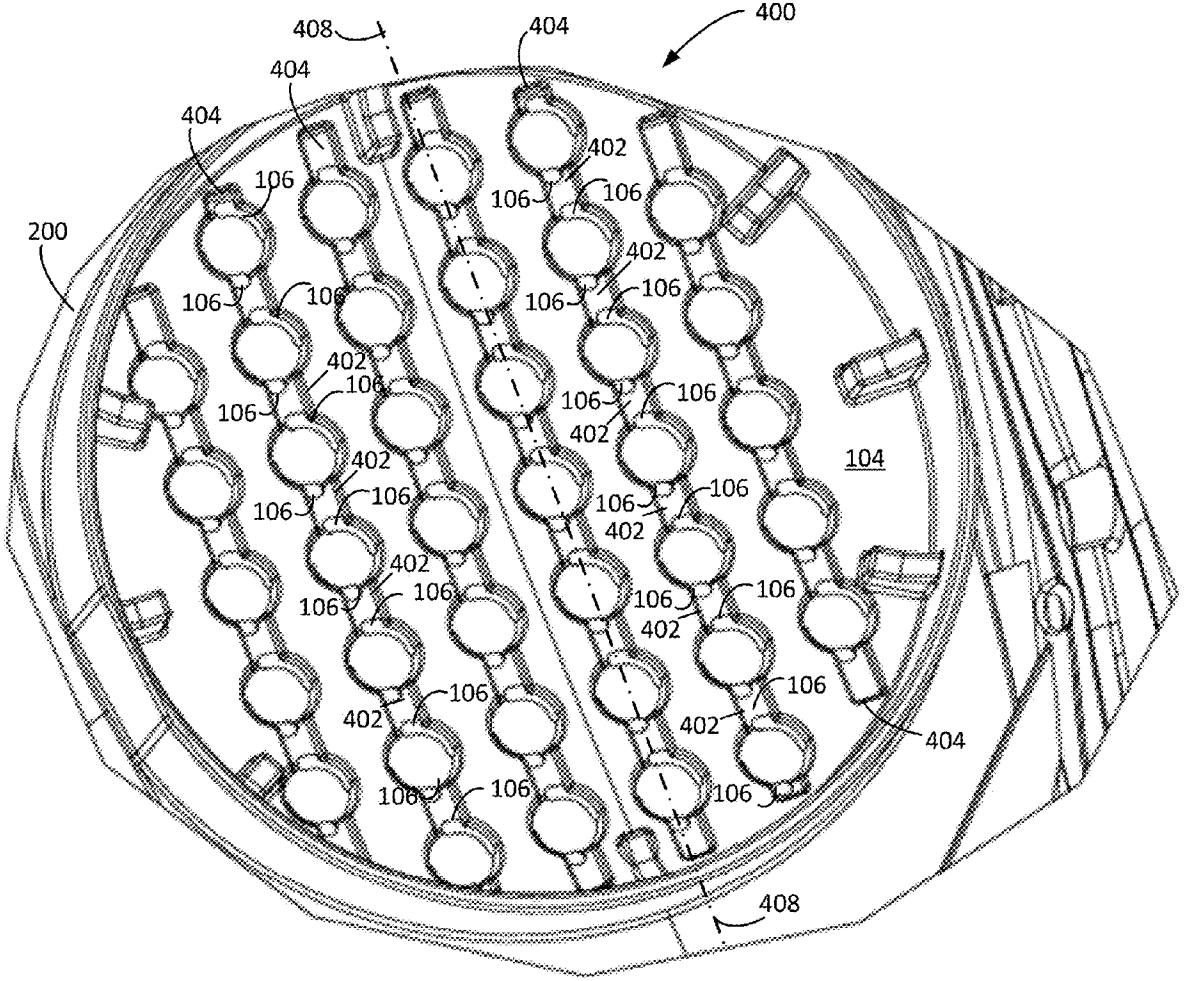
FIG. 4 is an enlarged rear perspective view of the front portion of the housing in FIG. 2B, which shows certain details associated with a speaker grille.
Figure 5A:
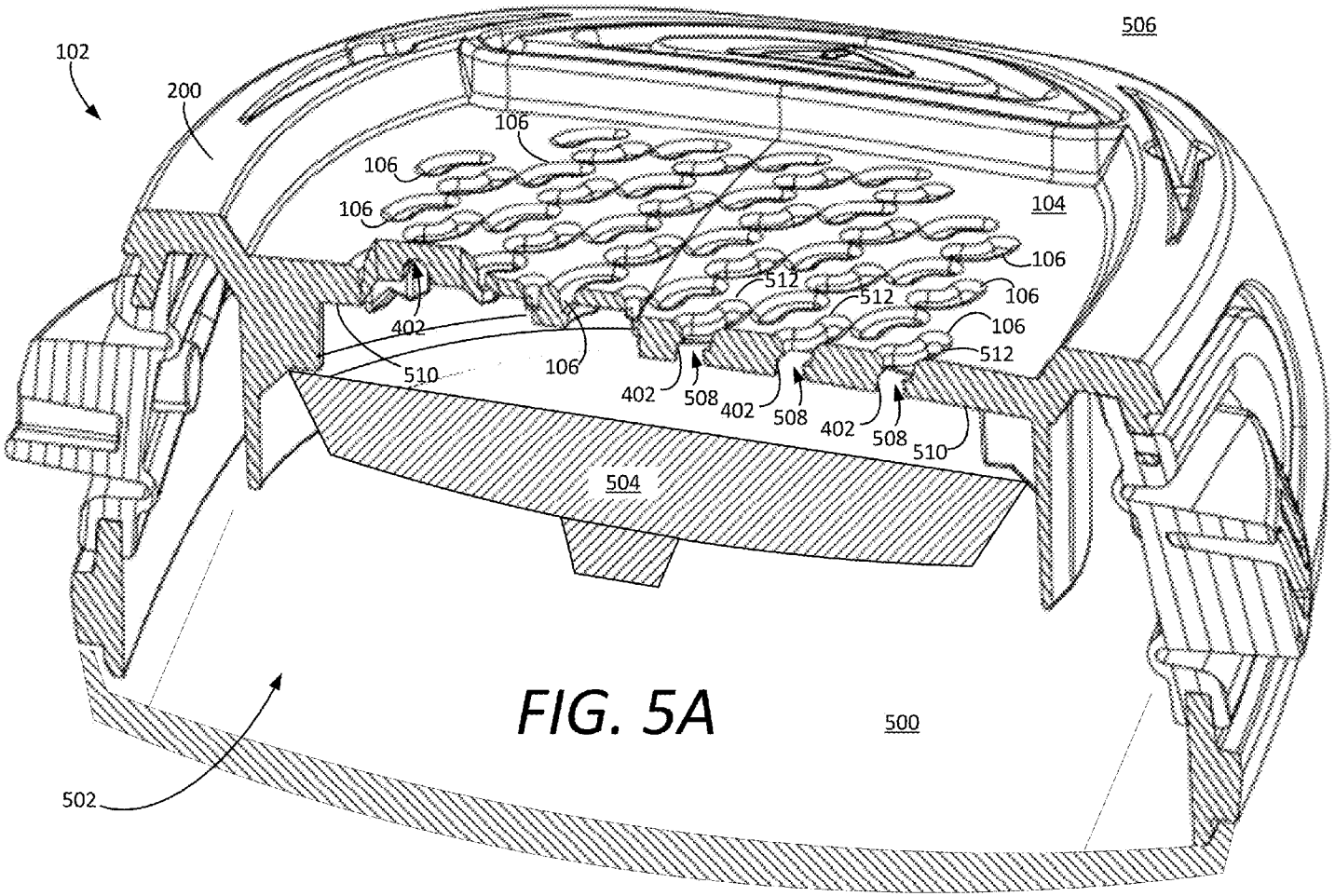
FIG. 5A is a perspective view of the housing shown in FIG. 1 with certain areas cut-away to show details associated with the speaker grille.
Figure 5B:
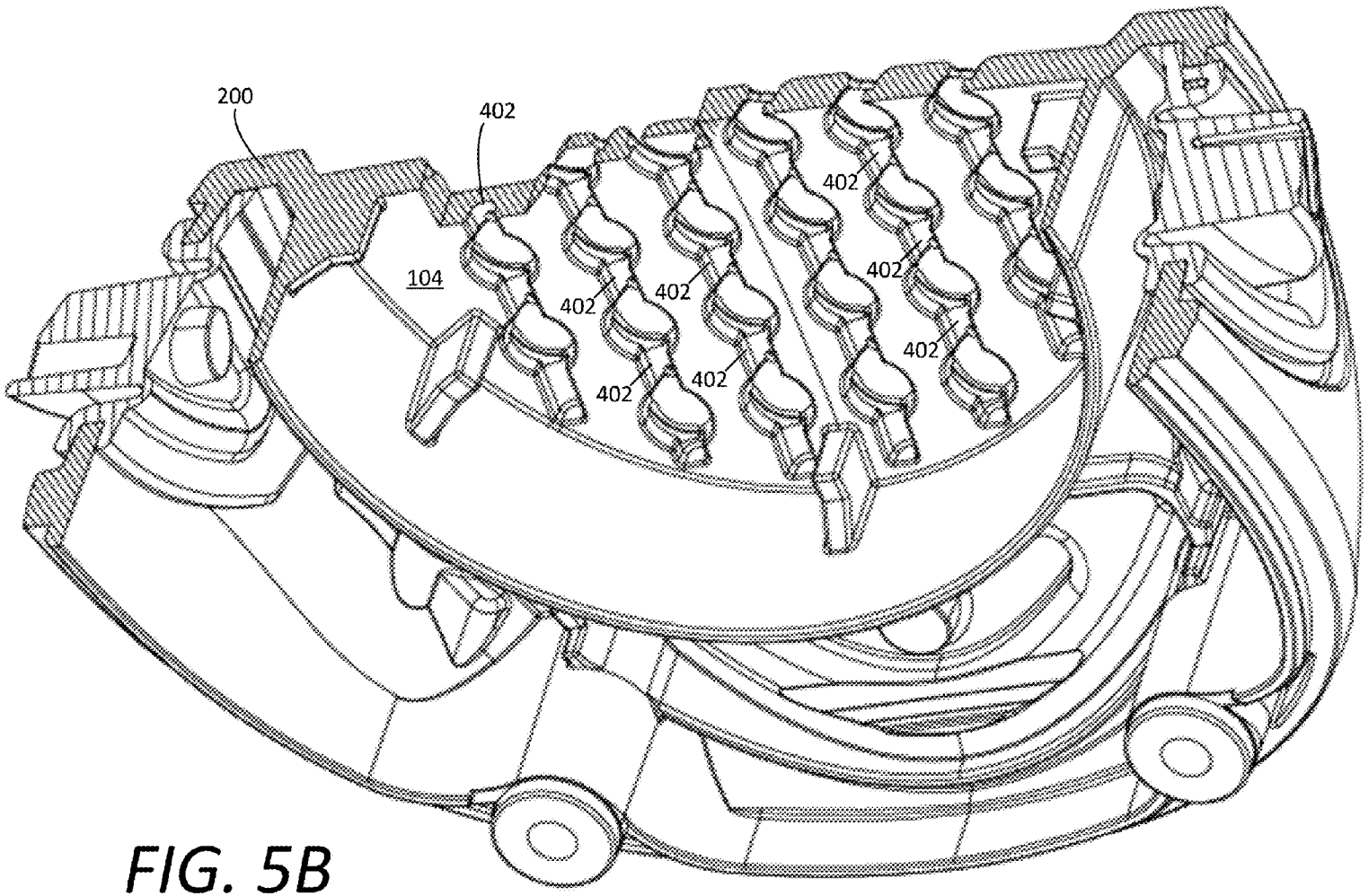
FIG. 5B is a perspective view of the front portion of the housing in FIG. 5A with areas cut away to show details associated with the speaker grille.

The panel 104 is shown in greater detail in FIGS. 4, 5A and 5B. According to one aspect, the acoustic apertures 106 can each be individually formed as kidney shaped elements as shown. However, the invention is not limited in this regard and other aperture shapes are also possible without limitation. Further, the acoustic apertures 106 are advantageously disposed in groups or sets which are connected by a plurality of channel segments 402 which together define a common fluid channel 404. The acoustic apertures in each set are advantageously disposed along a common centerline (e.g., centerline 408) so that the channel segments are aligned, and each of the fluid channels form a substantially linear fluid path as shown.

As shown in FIG. 5A, the housing 102 can include a rear portion 500 which mates with the front portion 200 to enclose a housing interior 502. A loudspeaker 504 is disposed within the housing interior 502. Accordingly, the acoustic apertures 106 facilitate transmission of audio reproduced by the loudspeaker 504 from the housing interior to an environment 506 surrounding the housing. Additional circuitry (not shown) can be provided inside the housing to provide a wired or wireless link which couples the loudspeaker to the output of a portable transceiver device.

The water management function of the housing panel 104 will now be explained in further detail. As is known, surface energy of a material is determined by measuring the tangent angle of a water droplet to the surface of the material. This angle is known as the Contact Angle. Low surface energy material will result in a high contact angle (contact angles greater than 90° deg), this will cause the water to bead. High surface energy material will result in a low contact angle (contact angles less than 90° deg), this will cause the water to wet the surface. A material that has low surface energy is called hydrophobic, meaning that it has a tendency to repel water. Material with high surface energy is called hydrophilic, meaning that water will flow on the surface.

Sharp edges, or pinning lines, inhibit the movement of water as the water surface needs to distort to move across the sharp angle at the pinning line. The plastic material used for a speaker microphone housing 102 can be slightly hydrophilic such that water will want to move into the acoustic apertures 106 due to capillary effects. Water becomes trapped in the acoustic apertures due to the pinning edges and high surface energy of the material. Blocked acoustic apertures 106 cause acoustic issues when attempting to use the speaker-microphone. In conventional systems these blocked apertures require the user to manually clear the blocked openings.

Figure 6:
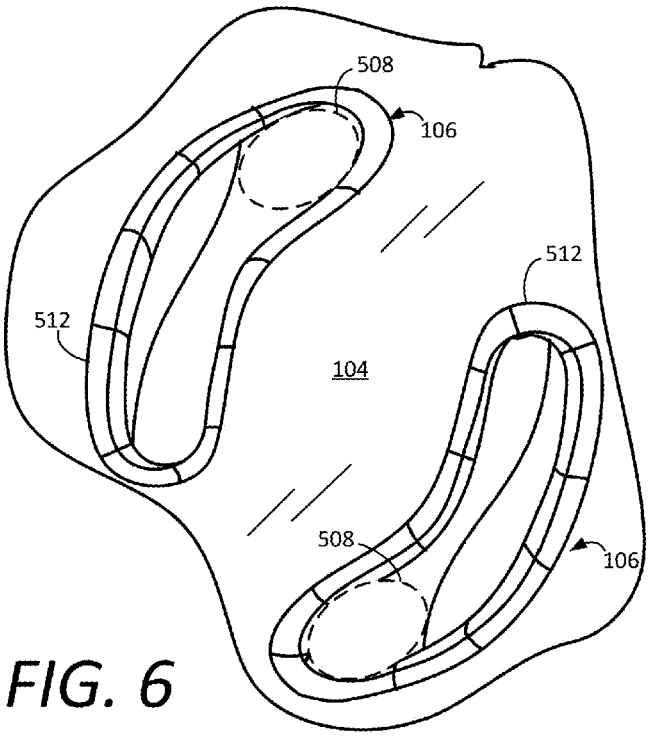
FIG. 6 is an enlarged perspective view showing a pair of acoustic apertures.

To overcome these issues, the acoustic apertures 106 are advantageously disposed in groups or sets which are connected by a plurality of channel segments 402. The channel segments 402 associated with a set of acoustic apertures together define a common fluid channel 404. The plurality of channel segments 402 advantageously have a U-shaped or V-shaped cross-sectional profile as hereinafter described. The acoustic apertures 106 define openings 508 at the bottom of the channel segments 402 on the interior side 510 of the housing panel 104. As best shown in FIG. 5A and FIG. 6, the size of the openings defined by the acoustic apertures 106 are tapered somewhat such that each opening decreases in area as it extends toward the interior of the housing. Consequently, the size of the openings 508 defined by the acoustic apertures 106 where they intersect or connect to the bottom of the channel segments 402 is smaller in contrast to the size of the openings 512 defined by the acoustic apertures at the exterior side of the housing panel 104. This significance of this difference in size will now be explained in further detail.

In order to understand certain operative features of the inventive arrangements, it is useful to discuss the concept of capillary pressure and the resulting movement of a fluid (e.g., water) in a capillary tube. For materials that are hydrophilic (i.e., where wetting or contact angles are less than 90°) water will preferentially move into smaller pores due to capillary pressures. For example, in FIG. 15, there is shown a capillary tube of circular geometry with two different diameters $a_1$ and $a_2$ as shown, where $a_1<a_2$. For a circular geometry, capillary pressure is given by the equation:

$$\Delta P=4\sigma \cos \theta/d$$

where

σ—surface tension (0.072 N/m for water)

θ—contact angle (measured from droplet angle to surface)

d—diameter of the capillary opening.

Figure 15:
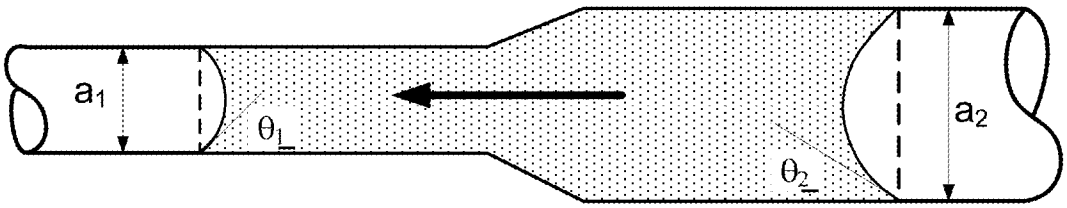
FIG. 15 is a drawing of an exemplary capillary tube that is useful for understanding the invention.

With the foregoing equation it can be shown that there is higher pressure in the larger diameter portion of the capillary tube in FIG. 15 as compared to the smaller diameter portion. Consequently, the fluid inside the capillary tube would move in the direction shown by the arrow (i.e., from the larger diameter capillary to the smaller diameter capillary. In the inventive arrangements, the plastic material used for the radio covers can be slightly hydrophilic (wetting or contact angles less than 90°). Accordingly, the water preferential moves into smaller pores due to capillary pressure as described herein.

As noted above, the size of the openings 508 defined by the acoustic apertures 106 where they intersect or connect to the bottom of the channel segments 402 is smaller in contrast to the size of the openings 512 defined by the acoustic apertures at the exterior side of the housing panel 104. Although the openings in each case are not necessarily circular, it is nevertheless true that capillary forces generated by the smaller connected opening 508 pulls water out of each acoustic aperture 106 and into each channel segment 402. Connecting the grille openings with narrow U-shaped or V-shaped channels promote wetting and pulls the water out of the grille and into the channel.

Figure 7:
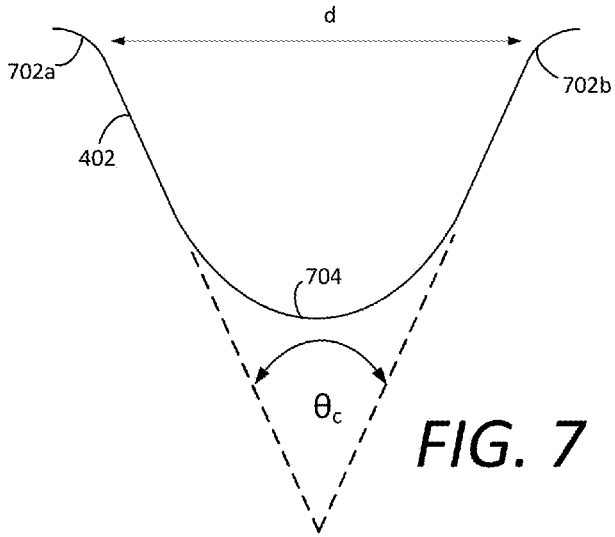
FIG. 7 is a schematic diagram that is useful for understanding a fluid channel design.

There is shown in FIG. 7 schematic diagram which represents a cross-sectional view of a U-shaped or V-shaped channel segment 402 as described herein. According to one aspect of the invention, the angle of the channel θ is advantageously selected by using the Concus-Finn equation:

$$\theta_c<\pi/2-\alpha \quad (1)$$

in which:

$\theta_c$ is the angle defined by the two walls of the channel; and

α is the contact angle (i.e., the tangent angle of a water droplet with respect to the surface of the panel 104 material which comprises the fluid channel segments 402)

As shown in FIG. 7, edges 704, 702*a*, 702*b* of a channel 402 will advantageously have a radius to eliminate the pinning phenomenon. The exact radius is not critical, but should be chosen so that it prevents pinning, and is manufacturable.

In the present invention, gravitational forces are necessary to overcome the capillary pressures after the water is drawn into the fluid channel. Bond Number $B_o$ is a dimensionless value that is used to define the ratio of the gravitational to surface tension or capillary pressures. The Bond Number is defined as follows:

$$B_o=\Delta\rho g L^2\sigma \quad (2)$$

where:

Δρ is the difference in density of the two phases;

g is gravitational acceleration;

L is the characteristic length; and

σ is the surface tension for the fluid (e.g. water).

Figure 8:
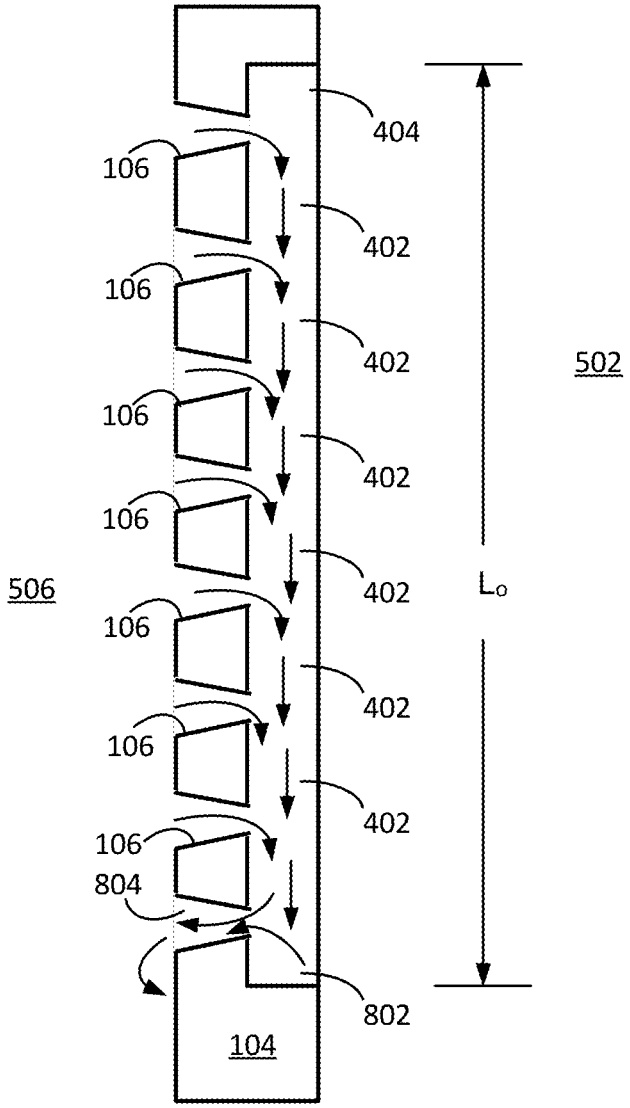
FIG. 8 is a schematic representation which shows a speaker grille panel in cross-section that is useful for understanding the invention.

The overall length $L_o$ of each of the fluid channel is advantageously scaled to achieve the gravitational head pressure needed to overcome the capillary forces. This allows the water droplets to flow down the fluid channel and push the water out the acoustic aperture that is located at the bottom of the speaker grille (i.e., at the lowermost acoustic aperture when the speaker-microphone is oriented in an intended use direction). Using the foregoing equations, the dimensions and geometry for the fluid channels 402, 404 can be selected so that water which is trapped in the acoustic apertures 106 is pulled into the fluid channels defined on the interior surface of housing panel 104, flows down the channels by the force of gravity, and exits the housing at the acoustic aperture opening defined at the lowest point along the fluid channel. This concept is schematically illustrated in FIG. 8 in which arrows show the process by which water which is trapped in acoustic apertures 106 is drawn into the channel segments 402 and proceeds down fluid channel 404 under the force of gravity until the fluid collects in lowermost lowermost channel segment 402 and/or exits the housing interior 502 through the lowermost acoustic aperture or drain aperture 804.

Figure 10:
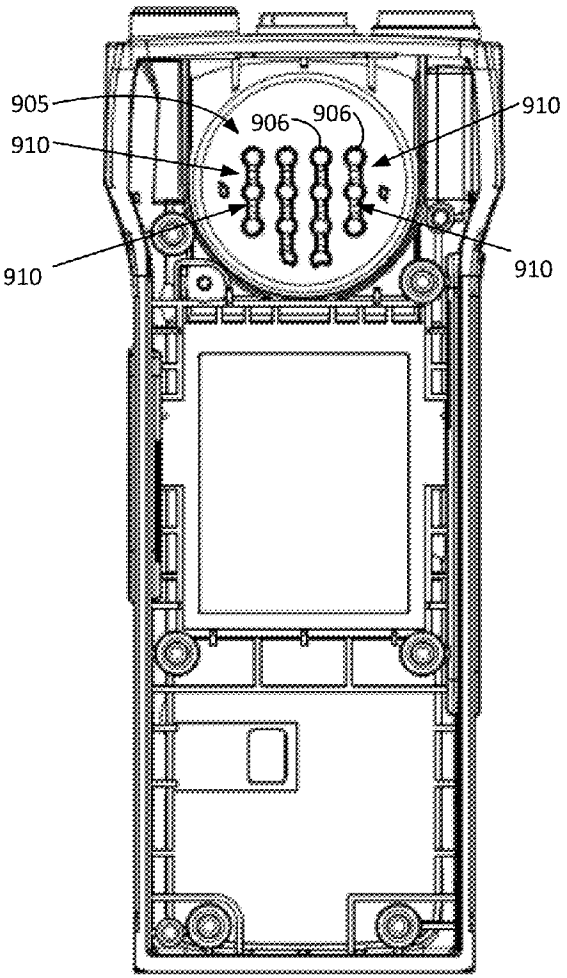
FIG. 10 is an interior view of a front housing portion of the portable radio in FIG. 9.
Figure 9:
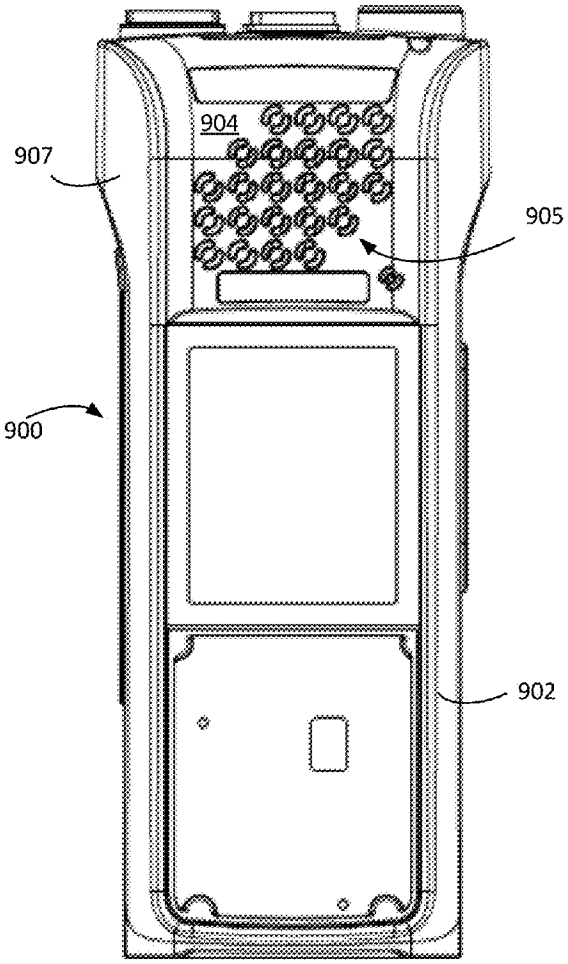
FIG. 9 is a portable radio transceiver that is useful for understanding the invention.
Figure 13:
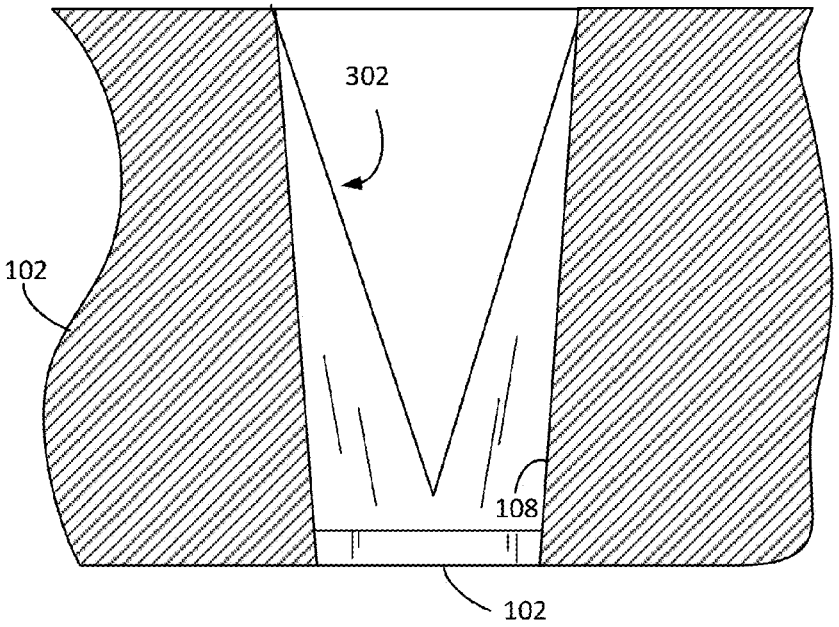
FIG. 13 is a cross-sectional view of a microphone port taken along line 13-13 in FIG. 11.
Figure 14:
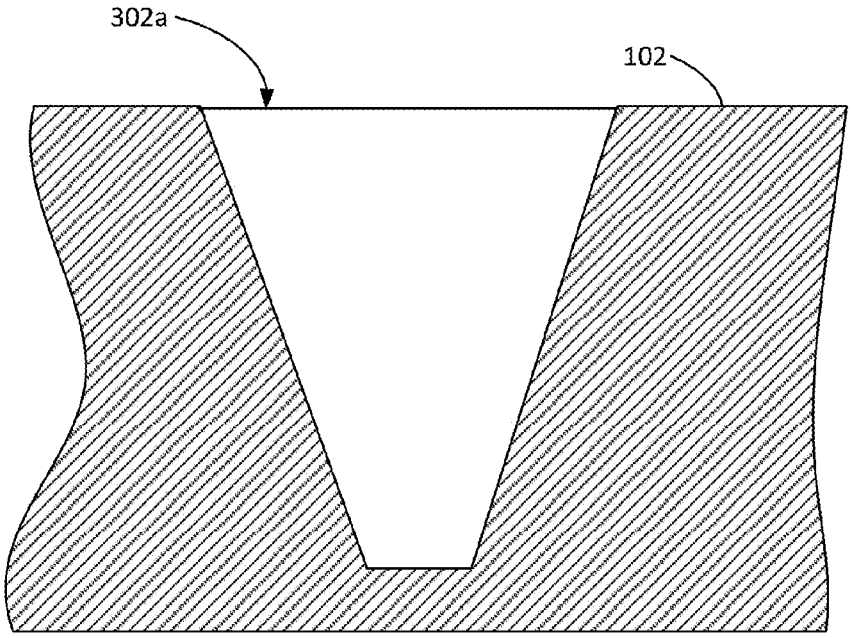
FIG. 14 is a cross-sectional view of the fluid channel associated with the microphone port, taken along line 14-14 in FIG. 11.

Referring now to FIG. 9, a different type of communication device is shown which includes a water management arrangement for a speaker grille which is similar to the water management arrangement described with respect to the speaker-microphone in FIGS. 1-8. The communication device in FIG. 9 is a hand-held portable radio transceiver 900. Portable radio transceivers are well known in the art and therefore will not be described in detail. However, it will be understood that a portable radio transceiver 900 can have a rigid housing 902 which includes a front housing portion 907 which includes a housing panel 904. The housing panel 904 defines a speaker grille 905 for a speaker (not shown). Referring now to FIG. 10, an interior side of the front housing portion 907 is shown. The speaker grille 905 can have a plurality of acoustic apertures 906 and fluid channels 910 which are similar to those described above in FIGS. 1-8 for extracting water from the acoustic aperture ports as described herein.

Figure 3:
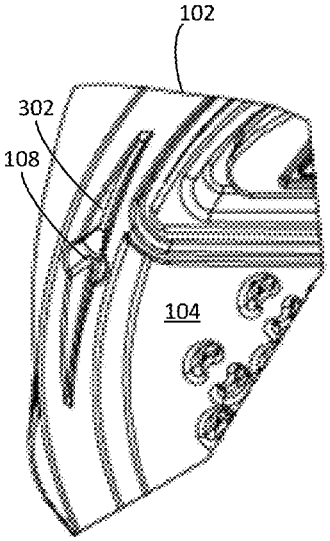
FIG. 3 shows a microphone port which is useful for understanding the invention.

A portable communication device as described in FIGS. 1-10 can also have one or more water management features associated with one or more microphone ports 108. As shown in FIG. 3, a microphone port 108 can be disposed within a microphone fluid management channel 302 formed on an outer surface of the housing 102. The fluid management channel 302 is shown in greater detail in FIGS. 11-14. It can be observed in FIG. 11-14 that the fluid management channel has a V-shaped profile. The fluid management channel is advantageously designed so that a water droplet which travels down the channel in a direction 1104 will collect additional water disposed in the channel and will thereby gain in fluid mass. As the water droplet continues to flow from the upper portion of the fluid channel 302*a*, over the microphone port 108, and toward the lower portion of the fluid channel 302*b*, it will draw out water that is trapped in the microphone port 108. The force of gravity is used to move the droplet along the length of the channel 302 and the channel is therefore oriented on the housing 102 so that it extends in a vertical direction when the speaker microphone is oriented in a predetermined usage orientation in which the communication device 100 is designed to be used. However, the fluid channels 302 can be curved so that it forms an arc as shown, and does not need to be precisely linear along its length. Ultimately water collected from the microphone port will exit the fluid channel as shown by arrows 1110.

The dimensions and geometry of the fluid channel 302 must be carefully selected to achieve the draining and extraction of fluid from the microphone port 108. Accordingly, the design of the fluid channel 302 will now be described in further detail. It can be observed that the cross-sectional profile of the upper portion 302*a* of the fluid channel 302 has a somewhat different profile as compared to the lower portion 302*b* of the fluid channel.

The terminology used herein is for the purpose of describing particular embodiments only and is not intended to be limiting of the invention. As used herein, the singular forms "a", "an" and "the" are intended to include the plural forms as well, unless the context clearly indicates otherwise. Furthermore, to the extent that the terms "including", "includes", "having", "has", "with", or variants thereof are used in either the detailed description and/or the claims, such terms are intended to be inclusive in a manner similar to the term "comprising."

While various embodiments of the present invention have been described above, it should be understood that they have been presented by way of example only, and not limitation. Numerous changes to the disclosed embodiments can be made in accordance with the disclosure herein without departing from the spirit or scope of the invention. Thus, the breadth and scope of the present invention should not be limited by any of the above described embodiments. Rather, the scope of the invention should be defined in accordance with the following claims and their equivalents.

We claim:

1. A communication device, comprising:

a housing formed of a rigid material which encloses a loudspeaker, the housing including a panel with a plurality of apertures defined therein to form a speaker grille which facilitates passage of audio from an interior portion of the housing enclosing the loudspeaker to an environment exterior of the housing;

each aperture defining a passage through the panel and decreasing in cross sectional area along a direction extending from an exterior side of the panel to an interior side of the panel;

the plurality of apertures arranged to form a plurality of aperture sets, each aperture set of the plurality of aperture sets comprised of at least two apertures connected by a respective fluid channel of a plurality of elongate fluid channels having a parallel arrangement and formed on an internal face of the panel, the respective fluid channel comprised of one or more channel segments, each extending along a fluid path between adjacent ones of the apertures comprising a respective aperture set of a plurality of aperture sets;

the respective fluid channel having a predetermined length which facilitates a gravitational head pressure needed to overcome a capillary force associated with at least one drain aperture.

2. A communication device according to claim 1, wherein the one or more channel segments comprising the respective fluid channel have a cross-sectional profile which is u-shaped or v-shaped.

3. The communication device according to claim 1, wherein the one or more channel segments are aligned along a common centerline so that the respective fluid channel defines a linear fluid path on the internal face of the panel.

4. The communication device according to claim 1, wherein the respective fluid channel extends in a vertical direction when the communication device is oriented in a predetermined usage orientation in which the communication device is designed to be used.

5. The communication device according to claim 4, wherein each aperture set includes at least one aperture which is the drain aperture disposed at a lowermost extremity of the aperture set when the portable communication device is in the predetermined usage orientation, wherein fluid droplets which enter any of the apertures in the aperture set from the external side of the panel are guided by the channel segments and the force of gravity toward said drain aperture.

6. The communication device according to claim 5, wherein the channel segments facilitate movement of the fluid droplets from at least a first one of the apertures to a second one of the apertures in the aperture set.

7. The communication device according to claim 6, wherein size and shape of the apertures and the channel segments are predetermined to cause the droplets of the fluid increase in fluid mass as they flow from the first one the apertures over the second and subsequent ones of the apertures in the aperture set.

8. The communication device according to claim 7, wherein the droplets increase in mass by accumulating additional fluid which is trapped in the second and subsequent aperture.

9. The communication device according to claim 7, wherein the accumulation of additional fluid in the droplet as it moves over the second and subsequent apertures causes extraction of the fluid trapped in one or more of the apertures.

10. The communication device according to claim 1, further comprising an interface circuit which couples the loudspeaker to a portable radio transceiver by means of a wired or wireless link.

11. The communication device according to claim 1, further comprising at least one radio transceiver coupled to the loudspeaker.

12. The communication device according to claim 1, further comprising a second fluid channel defined in an exterior face of the housing and forming a second fluid path; and a microphone aperture disposed in said housing to facilitate passage of audio between the environment exterior of the housing and a microphone disposed within the interior portion of the housing.

13. A communication device, comprising:

a housing formed of a rigid material which encloses a loudspeaker, the housing including a panel with a plurality of apertures defined therein to form a speaker grille which facilitates passage of audio from an interior portion of the housing enclosing the loudspeaker to an environment exterior of the housing;

each aperture defining a passage through the panel and decreasing in cross sectional area along a direction extending from an exterior side of the panel to an interior side of the panel;

the plurality of apertures arranged to form a plurality of aperture sets, each aperture set of the plurality of aperture sets comprised of at least two apertures connected by a respective fluid channel of a plurality of elongate fluid channels defined on an internal face of the panel, the respective fluid channel comprised of one or more channel segments, each extending a fluid path between adjacent ones of the apertures comprising a respective aperture set of a plurality of aperture sets;

the respective fluid channel having a predetermined length which facilitates a gravitational head pressure needed to overcome a capillary force associated with at least one drain aperture; and wherein each of the channels segments and the plurality of apertures has a predetermined geometry and size which assists to draws fluid through the apertures from an exterior side of the panel, to an interior side of the panel, into one of the channel segments, and to expel the fluid from the interior side of the panel through the at least one drain aperture.

14. A communication device according to claim 13, wherein the one or more channel segments comprising the respective fluid channel have a cross-sectional profile which is u-shaped or v-shaped.

15. The communication device according to claim 13, wherein the one or more channel segments are aligned along a common centerline so that the respective fluid channel defines a linear fluid path on the internal face of the panel.

16. A method for clearing water from a speaker grille of a communication device, comprising:

providing a housing for the communication device formed of a rigid material which encloses a loudspeaker;

including in a panel of the housing a plurality of apertures to form a speaker grille which facilitates passage of audio from an interior portion of the housing enclosing the loudspeaker to an environment exterior of the housing;

causing in said plurality of apertures a difference in capillary pressure which draws an accumulation of fluid through the plurality of apertures from an exterior side of the panel into to at least one of a plurality of channel segments forming at least one fluid channel disposed on an interior side of the panel; and expelling at least a portion of the fluid from the interior side of the panel to the exterior side of the panel through at least one drain aperture, by using a gravitational head pressure developed in the fluid channel by the force of gravity;

wherein the plurality of apertures are arranged to form a plurality of aperture sets, each aperture set of the plurality of aperture sets comprised of at least two apertures connected by a respective fluid channel of a plurality of fluid channels formed on the interior side of the panel.

17. The method according to claim 16, further comprising forming the plurality of apertures so that a cross sectional area of each aperture decreases along a direction extending from an exterior side of the panel to an interior side of the panel.

18. The method according to claim 16, further comprising selecting a length of the fluid channel which facilitates a gravitational head pressure needed to overcome a capillary force associated with at least one drain aperture.

19. The method according to claim 16, further comprising:

disposing a second fluid channel on an exterior face of the housing to form a second fluid path; and guiding at least one fluid droplet along the second fluid channel to aid in clearing fluid trapped by capillary pressure in a microphone aperture disposed in the second fluid path.

* * * * *